US010324418B2

(12) United States Patent
Kohler et al.

(10) Patent No.: US 10,324,418 B2
(45) Date of Patent: Jun. 18, 2019

(54) METHOD FOR FABRICATION OF A BALANCE SPRING OF PREDETERMINED THICKNESS THROUGH THE ADDITION OF MATERIAL

(71) Applicant: CSEM Centre Suisse d'Electronique et de Microtechnique SA-Recherche et developpement, Neuchatel (CH)

(72) Inventors: Frederic Kohler, Avry-sur-Matran (CH); Jean-Luc Bucaille, Presilly (FR); Olivier Hunziker, Vevey (CH)

(73) Assignee: CSEM Centre Suisse d'Electronique et de Microtechnique SA-Recherche et développement, Neuchâtel (CH)

( * ) Notice: Subject to any disclaimer, the term of this patent is extended or adjusted under 35 U.S.C. 154(b) by 67 days.

(21) Appl. No.: 15/372,725

(22) Filed: Dec. 8, 2016

(65) Prior Publication Data

US 2017/0176942 A1 Jun. 22, 2017

(30) Foreign Application Priority Data

Dec. 18, 2015 (EP) ..... 15201337

(51) Int. Cl.
*G04B 17/06* (2006.01)
*G04D 7/10* (2006.01)
*G04B 17/22* (2006.01)

(52) U.S. Cl.
CPC ..... *G04B 17/066* (2013.01); *G04B 17/22* (2013.01); *G04D 7/10* (2013.01)

(58) Field of Classification Search
CPC ..... G04B 17/066; G04D 7/10
See application file for complete search history.

(56) References Cited

U.S. PATENT DOCUMENTS

2005/0281137 A1* 12/2005 Bourgeois ..... F16F 1/021 368/175
2012/0048035 A1* 3/2012 Cerutti ..... G04D 7/08 73/862.321
2013/0272100 A1 10/2013 Klinger et al.
2013/0308430 A1 11/2013 Verardo et al.
2015/0261187 A1* 9/2015 Hessler ..... G04B 17/06 368/170
2016/0238994 A1* 8/2016 Ching ..... G04B 17/066
2016/0370763 A1* 12/2016 Cusin ..... G04B 17/34

FOREIGN PATENT DOCUMENTS

CH 709 516 A2 10/2015
EP 1 213 628 A1 6/2002
EP 2 455 825 A1 5/2012
WO WO 2012/007460 A1 1/2012

OTHER PUBLICATIONS

European Search Report dated May 24, 2016 in European Application 15201337, filed on Dec. 18, 2015 ( with English translation of Categories of Cited Documents).

* cited by examiner

*Primary Examiner* — Moshe Wilensky
(74) *Attorney, Agent, or Firm* — Oblon, McClelland, Maier & Neustadt, L.L.P.

(57) ABSTRACT

The invention relates to a method for fabrication of a balance spring of a predetermined stiffness comprising the steps of fabricating a balance spring in dimensions to obtain a deliberately lower stiffness, determining the stiffness of the balance spring formed in step a) in order to compensate for said missing thickness of material required to obtain the balance spring having the dimensions necessary for said predetermined stiffness.

20 Claims, 3 Drawing Sheets

METHOD FOR FABRICATION OF A BALANCE SPRING OF PREDETERMINED THICKNESS THROUGH THE ADDITION OF MATERIAL

This application claims priority from European Patent Application No 15201337.1 of Dec. 18, 2015, the entire disclosure of which is hereby incorporated herein by reference.

FIELD OF THE INVENTION

The invention relates to a method for fabrication of a balance spring of predetermined stiffness and, more specifically, such a balance spring used as a compensating balance spring cooperating with a balance of predetermined inertia to form a resonator having a predetermined frequency.

BACKGROUND OF THE INVENTION

It is explained in EP Patent 1422436, incorporated in the present Application by reference, how to form a compensating balance spring comprising a silicon core coated with silicon dioxide and cooperating with a balance having a predetermined inertia for thermal compensation of said entire resonator.

The fabrication of such a compensating balance spring offers numerous advantages but also has drawbacks. Indeed, the step of etching several balance springs in a silicon wafer offers a significant geometric dispersion between the balance springs of the same wafer and a greater dispersion between the balance springs of two wafers etched at different times. Incidentally, the stiffness of each balance spring etched with the same etch pattern is variable, creating significant fabrication dispersions.

SUMMARY OF THE INVENTION

It is an object of the present invention to overcome all of part of the aforecited drawbacks by proposing a method for fabrication of a balance spring whose dimensions are sufficiently precise not to require further operations.

The invention therefore relates to a method for fabrication of a balance spring of a predetermined stiffness including the following steps:

a) Forming a balance spring in dimensions smaller than the dimensions necessary to obtain said balance spring of a predetermined stiffness;

b) determining the stiffness of the balance spring formed in step a) by measuring the frequency of said balance spring coupled with a balance having a predetermined inertia;

c) calculating the missing thickness of material, based on the determination of the stiffness of the balance spring determined in step b), to obtain said balance spring of a predetermined stiffness;

d) modifying the balance spring formed in step a), to compensate for said missing thickness of material in order to obtain the balance spring (5*c*) in the dimensions necessary for said predetermined stiffness.

It is thus understood that the method can guarantee very high dimensional precision of the balance spring, and incidentally, a more precise stiffness of said balance spring. Any fabrication parameter able to cause geometric variations in step a) can thus be completely rectified for each fabricated balance spring, or rectified on average for all the balance springs formed at the same time, thereby drastically reducing the scrap rate.

In accordance with other advantageous variants of the invention:

- in step a), the dimensions of the balance spring formed in step a) are between 1% and 20% smaller than those necessary to obtain said balance spring with said predetermined stiffness;
- step a) is achieved by means of deep reactive ion etching or chemical etching;
- in step a), several balance springs are formed in the same wafer in dimensions smaller than the dimensions necessary to obtain several balance spring of a predetermined stiffness or several balance springs of several predetermined stiffnesses;
- the balance spring formed in step a) is made from silicon, glass, ceramic, metal or metal alloy;
- step b) comprises phase b1): measuring the frequency of an assembly comprising the balance spring formed in step a) coupled with a balance having a predetermined inertia, and phase b2): deducing, from the measured frequency, the stiffness of the balance spring formed in step a);
- according to a first variant, step d) comprises phase d1): depositing a layer on one part of the external surface of the balance spring formed in step a) in order to obtain the balance spring in the dimensions necessary for said predetermined stiffness;
- according to a second variant, step d) comprises phase d2): modifying the structure, to a predetermined depth, of one part of the external surface of the balance spring formed in step a), in order to obtain the balance spring in the dimensions necessary for said predetermined stiffness;
- according to a third variant, step d) comprises phase d3): modifying the composition, to a predetermined depth, of one part of the external surface of the balance spring obtained in step a), in order to obtain the balance spring in the dimensions necessary for said predetermined stiffness;
- after step d), the method performs, at least once more, steps b), c) and d) to further improve the dimensional quality;
- according to a first variant, step e) comprises phase e1): depositing a layer on one part of the external surface of said balance spring of a predetermined stiffness;
- in a second variant, step e) comprises phase e2): modifying the structure, to a predetermined depth, of one part of the external surface of said balance spring of a predetermined stiffness;
- according to a third variant, step e) comprises phase e3): modifying the composition, to a predetermined depth, of one part of the external surface of said balance spring of a predetermined stiffness.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
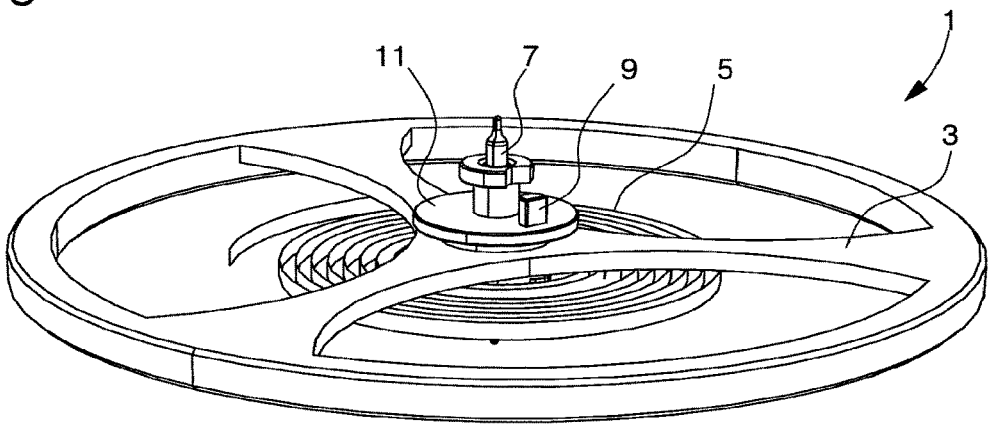
FIG. 1 is a perspective view of an assembled resonator according to the invention.

As illustrated in FIG. 1, the invention relates to a resonator 1 of the type with a balance 3-balance spring 5. Balance 3 and balance spring 5 are preferably mounted on the same arbor 7. In this resonator 1, the moment of inertia I of balance 3 answers to the formula:

$$I=mr^2 \tag{1}$$

where m represents its mass and r the turn radius which also depends on temperature through the expansion coefficient $\alpha_b$ of the balance.

Further, the stiffness C of balance spring 5 of constant cross-section responds to the formula:

$$C=\frac{Ehe^3}{12L} \tag{2}$$

where E is the Young's modulus of the material used, h the height, e the thickness and L the developed length thereof.

Further, the stiffness C of a balance spring 5 of constant cross-section responds to the formula:

$$C=\frac{E}{12}\frac{1}{\int_0^L \frac{1}{h(l)e^3(l)}dl} \tag{3}$$

where E is the Young's modulus of the material used, h the height, e the thickness and L the developed length and I the curvilinear abscissa along the balance spring.

Further, the stiffness C of a balance spring 5 of variable thickness but constant cross-section responds to the formula:

$$C=\frac{Eh}{12}\frac{1}{\int_0^L \frac{1}{e^3(l)}dl} \tag{4}$$

where E is the Young's modulus of the material used, h the height, e the thickness and L the developed length and I the curvilinear abscissa along the balance spring.

Finally, the elastic constant C of sprung balance resonator 1 answers to the formula:

$$f=\frac{1}{2\pi}\sqrt{\frac{C}{I}} \tag{5}$$

According to the invention, it is desired that a resonator has substantially zero frequency variation with temperature. The frequency variation f with temperature T in the case of a sprung-balance resonator substantially follows the following formula:

$$\frac{\Delta f}{f}=\frac{1}{2}\left\{\frac{\partial E}{\partial T}\frac{1}{E}+3\cdot\alpha_s-2\cdot\alpha_b\right\}\cdot\Delta T \tag{6}$$

where:

$$\frac{\Delta f}{f}$$

is a relative frequency variation;

ΔT is the temperature variation;

$$\frac{\partial E}{\partial T}\frac{1}{E}$$

is the relative Young's modulus variation with temperature, i.e. the thermoelastic coefficient (TEC) of the balance spring;

$\alpha_s$ is the expansion coefficient of the balance spring, expressed in ppm.° C.$^{-1}$;

$\alpha_b$ is the expansion coefficient of the balance, expressed in ppm.° C.$^{-1}$ Since the oscillations of any resonator intended for a time or frequency base must be maintained, the maintenance system may also contribute to thermal dependence, such as, for example, a Swiss lever escapement (not shown) cooperating with the impulse pin 9 of the roller 11, also mounted on arbor 7.

It is thus clear, from formulae (1)-(6), that through the choice of materials used to couple balance spring 5 with balance 3, for the frequency f of resonator 1 to be virtually insensitive to temperature variations.

The invention more particularly concerns a resonator 1 wherein the balance spring 5 is used to thermally compensate the entire resonator 1, i.e. all the parts and particularly the balance 3. Such a balance spring 5 is generally called a temperature compensating balance spring. This is why the invention relates to a method that can guarantee very high dimensional precision of the balance spring, and incidentally, guarantee a more precise stiffness of said balance spring.

According to the invention, compensating balance spring 5, 15 is formed from a material, possibly coated with a thermal compensation layer, and intended to cooperate with a balance 3 having a predetermined inertia. However, there is nothing to prevent the use of a balance with movable inertia-blocks able to offer an adjustment parameter prior to or after the sale of the timepiece.

The utilisation of a material, for example made from silicon, glass or ceramic, for the fabrication of a balance spring 5, 15 offers the advantage of being precise via existing etching methods and of having good mechanical and chemical properties while being virtually insensitive to magnetic fields. It must, however, be coated or surface modified to be able to form a compensating balance spring.

Preferably, the silicon-based material used to make the compensated balance spring may be single crystal silicon, regardless of its crystal orientation, doped single crystal silicon, regardless of its crystal orientation, amorphous silicon, porous silicon, polycrystalline silicon, silicon nitride, silicon carbide, quartz, regardless of its crystal orientation, or silicon oxide. Of course, other materials may be envisaged, such as glass, ceramics, cermets, metals or metal alloys. For the sake of simplification, the following explanation will concern a silicon-based material.

Each material type can be surface-modified or coated with a layer to thermally compensate the base material as explained above.

Although the step of etching balance springs in a silicon-based wafer, by means of deep reactive ion etching (DRIE) is the most precise, phenomena which occur during the etch or between two successive etches may nonetheless cause geometric variations.

Of course, other fabrication types may be implemented, such as laser etching, focused ion beam etching (FIB), galvanic growth, growth by chemical vapour deposition or chemical etching, which are less precise and for which the method would be even more meaningful.

Figure 3:
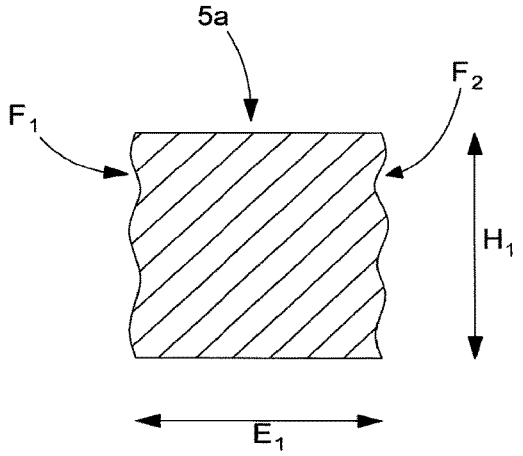
FIGS. 3 to 5 are cross-sections of the balance spring in different steps of the method according to the invention.
Figure 7:
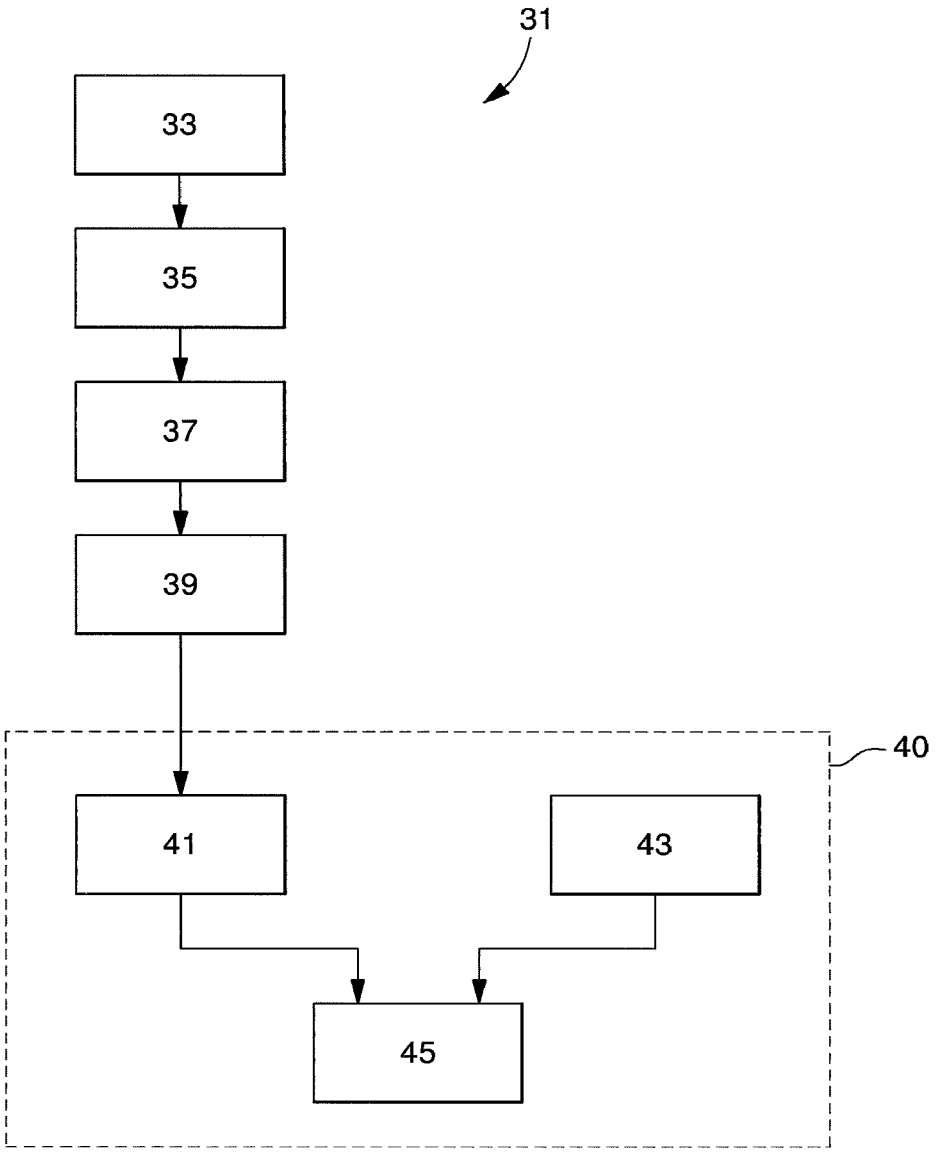
FIG. 7 is a diagram of the method according to the invention.

Thus, the invention relates to a method 31 for fabrication of a balance spring 5*c*. According to the invention, method 31 comprises, as illustrated in FIG. 7, a first step 33 intended to form at least one balance spring 5*a*, for example from silicon, in dimensions Da smaller than the dimensions Db necessary to obtain said balance spring 5*c* of a predetermined stiffness C. As seen in FIG. 3, the cross-section of balance spring 5*a* has a height $H_1$ and a thickness $E_1$.

Preferably, the dimensions Da of balance spring 5*a* are substantially between 1% and 20% smaller than those Db of balance spring 5*c* necessary to obtain said balance spring 5*c* of a predetermined stiffness C.

Figure 6:
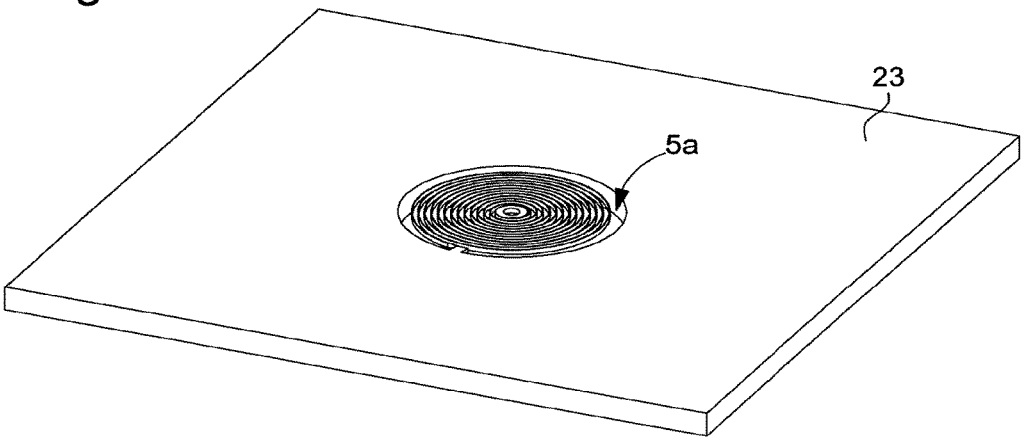
FIG. 6 is a perspective view of a step of the method according to the invention.

Preferably according to the invention, step 33 is achieved by means of a deep reactive ion etch in a wafer 23 of silicon-based material, as illustrated in FIG. 6. It is noted that the opposite faces $F_1$, $F_2$ are undulating since a Bosch deep reactive ion etch results in an undulating etch, structured by the successive etch and passivation steps.

Of course, the method is not limited to a particular step 33. By way of example, step 33 could also be obtained by means of a chemical etch in a wafer 23, for example of silicon-based material. Further, step 33 means that one or more balance springs are formed, i.e. step 33 can form individual loose balance springs or, alternatively, balance springs formed in a wafer of material.

Consequently, in step 33, several balance springs 5*a* can be formed in the same wafer 23 in dimensions Da, $H_1$, $E_1$ smaller than the dimensions Db, $H_2$, $E_2$ necessary to obtain several balance springs 5*c* of a predetermined stiffness C or several balance springs 5*c* of several predetermined stiffnesses C.

Step 33 is also not limited to forming a balance spring 5*a* in dimensions Da, $H_1$, $E_1$ smaller than the dimensions Db, $H_2$, $E_2$ necessary to obtain a balance spring 5*c* of a predetermined stiffness C, produced using a single material. Thus, step 33 could also form a balance spring 5*a* in dimensions Da, $H_1$, $E_1$ smaller than the dimensions Db, $_H2$, $_E2$ a necessary to obtain a balance spring 5*c* of a predetermined stiffness C made from a composite material, i.e. comprising several distinct materials.

Method 31 includes a second step 35 intended to determine the stiffness of balance spring 5*a*. This step 35 may be performed directly on a balance spring 5*a* still attached to wafer 23 or on a balance spring 5*a* previously detached from wafer 23, on all, or on a sample of the balance springs still attached to a wafer 23, or on a sample of balance springs previously detached from a wafer 23.

Preferably according to the invention, regardless of whether or not balance spring 5*a* is detached from wafer 23, step 35 includes a first phase intended to measure the frequency f of an assembly comprising balance spring 5*a* coupled to a balance having a predetermined inertia I and then, using the relation (5), to deduce therefrom, in a second phase, the stiffness C of balance spring 5*a*.

This measuring phase may, in particular, be dynamic and performed in accordance with the teaching of EP Patent 2423764, incorporated by reference in the present Application. However, alternatively, a static method, performed in accordance with the teaching of EP Patent 2423764, may also be implemented to determine the stiffness C of balance spring 5*a*.

Of course, as explained above, since the method is not limited to the etching of only one balance spring per wafer, step 35 may also consist in the determination of the mean stiffness of a representative sample, or of all the balance springs formed on the same wafer.

Advantageously according to the invention, based on the determination of the stiffness C of balance spring 5*a*, method 31 includes a step 37 intended to calculate, with the aid of relation (2), the missing thickness of material required to obtain balance spring 5*c* of a predetermined stiffness C, i.e. the volume of material to be added and/or to be modified in a homogeneous or non-homogeneous manner, on the surface of balance spring 5*a*.

The method continues with a step 39 intended to modify balance spring 5*a* formed in step a), to compensate for said missing thickness of material required to obtain balance spring 5*c* in the dimensions Db, $H_2$, $E_2$ necessary for said predetermined stiffness C. It is therefore understood that it does not matter whether geometric variations have occurred in the thickness and/or the height and/or the length of balance spring 5*a* given that, according to equation (2), it is the product $h \cdot e^3$ that determines the stiffness of the coil.

Thus, a homogeneous thickness can be added and/or modified on the entire external surface, a non-homogeneous thickness can be added and/or modified on the entire external surface, a homogeneous thickness can be added and/or modified on only one part of the external surface, or a non-homogeneous thickness can be added and/or modified on only one part of the external surface. By way of example, step 39 could consist in only adding material to the thickness $E_1$ or to the height $H_1$ of balance spring 5*a*.

In a first variant, step 39 includes a phase d1 intended to deposit a layer on one part of the external surface of balance spring 5*a* formed in step 33, in order to obtain balance spring 5*c* in the dimensions Db, $H_2$, $E_2$ necessary for said predetermined stiffness C. This phase d1 may, for example, be obtained by thermal oxidation, by galvanic growth, by physical phase deposition (PVD), by chemical phase deposition (CVD), by atomic layer deposition (ALD), or by any other method of addition.

This phase d1 may, for example, be achieved by a chemical vapour deposition allowing polysilicon to be formed on the single crystal silicon balance spring 5*a*, to obtain balance spring 5*c* in the dimensions Db, $H_2$, $E_2$ necessary for predetermined stiffness C.

Figure 4:
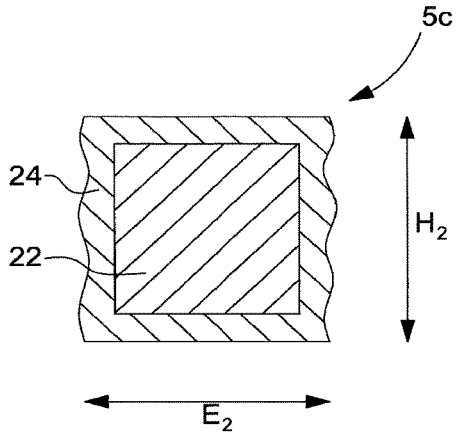

As seen in FIG. 4, the cross-section of balance spring 5*c* has a height $H_2$ and a thickness $E_2$. It is noted that balance spring 5*c* is formed of a central part 22 made from single crystal silicon and a peripheral part 24 made from polycrystalline silicon in the overall dimensions Db necessary for predetermined stiffness C.

In a second variant, step 39 may consist of a phase d2 intended to modify the structure, to a predetermined depth, of one part of the external surface of balance spring 5*a* in order to obtain balance spring 5*c* in the dimensions Db, $H_2$, $E_2$ necessary for predetermined stiffness C. By way of example, illustrated in FIG. 4, if amorphous silicon is used to form balance spring 5*a*, it could be crystallised to a predetermined depth to form an amorphous silicon central part 22 and a polycrystalline silicon peripheral part 24, to obtain balance spring 5*c* in the dimensions Db, $H_2$, $E_2$ necessary for predetermined stiffness C.

In a third variant, step 39 may consist of a phase d3 intended to modify the composition, to a predetermined depth, of one part of the external surface of balance spring 5*a* of a predetermined stiffness C. By way of example, illustrated in FIG. 4, if single crystal or polycrystalline silicon is used to form balance spring 5*a*, it could be doped or diffused with interstitial or substitional atoms, to a predetermined depth, to form a single crystal or polycrystalline silicon central part 22 and a peripheral part 24 doped or diffused with different silicon atoms, to obtain balance spring 5*c* in the dimensions Db, $H_2$, $E_2$ necessary for predetermined stiffness C. It is understood that this third variant does not necessarily involve an increase in volume but at least superficially increases the Young's modulus to obtain predetermined stiffness C.

For these three variants, it is seen that the undulating shape is always reproduced on a portion of peripheral part 24 and central part 22. Thus, a smoothing step may be provided before step 39 to attenuate, or remove, any undulating shape of balance spring 5*a*.

Method 31 may end with step 39. However, after step 39, method 31 may also perform, at least once more, steps 35, 37 and 39 in order to further improve the dimensional quality of the balance spring. These iterations of steps 35, 37 and 39 may, for example, be of particular advantage when the first iteration of steps 35, 37 and 39 is performed on all, or on a sample, of the balance springs still attached to a wafer 23, and then, in a second iteration, on all, or a sample, of the balance springs previously detached from wafer 23 and having undergone the first iteration.

Method 31 may also continue with all or part of process 40 illustrated in FIG. 7, comprising optional steps 41, 43 and 45. Advantageously according to the invention, method 31 may thus continue with step 41 intended to form, on at least one part of balance spring 5*c*, a portion 26 for correcting the stiffness of balance spring 5*c* and for forming a balance spring 5, 15 that is less sensitive to thermal variations.

In a first variant, step 41 may consist of a phase e1 intended to deposit a layer on one part of the external surface of said balance spring 5*c* of a predetermined stiffness C.

In the case where parts 22/24 are made from a silicon-based material, phase e1 may consist in oxidising balance spring 5*c* to coat it with silicon dioxide to correct the stiffness of balance spring 5*c* and to form a balance spring 5, 15 which is temperature compensated. This phase e1 may, for example, be obtained by thermal oxidation. This thermal oxidation may, for example, be achieved between 800 and 1200° C. in an oxidising atmosphere with the aid of water vapour or dioxygen gas to form silicon oxide on balance spring 5*c*.

Figure 5:
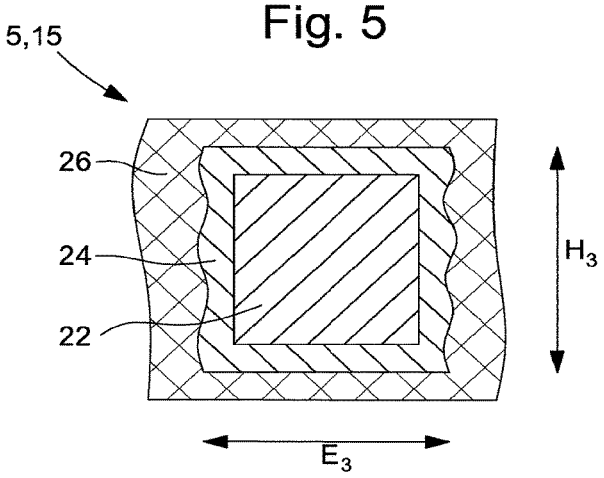

There is thus obtained compensating balance spring 5, 15, as illustrated in FIG. 5 which, advantageously according to the invention, comprises a composite silicon core 22/24 and a silicon oxide coating 26. Advantageously according to the invention, compensating balance spring 5, 15 therefore has a very high dimensional precision, particularly as regards height $H_3$ and thickness $E_3$, and, incidentally, very fine temperature compensation of the entire resonator 1.

In the case of a silicon-based balance spring, the overall dimensions Db may be found by using the teaching of EP Patent 1422436 to apply to the resonator 1 which is intended to be fabricated, i.e to compensate all of the constituent parts of resonator 1, as explained above.

In a second variant, step 41 may consist in a phase e2 intended to modify the structure, to a predetermined depth, of one part of the external surface of said balance spring 5*c* of a predetermined stiffness C. By way of example, if an amorphous silicon is used for peripheral part 24 and possibly, central part 22, it could be crystallised to a predetermined depth in peripheral part 24 and possibly in central part 22.

In a third variant, step 41 may consist in a phase e3 intended to modify the composition, to a predetermined depth, of one part of the external surface of said balance spring 5*c* of a predetermined stiffness C. By way of example, if a single crystal silicon or polycrystalline silicon is used for peripheral part 24 and, possibly, central part 22, it could be doped or diffused with interstitial or substitional atoms, to a predetermined depth, in peripheral part 24 and, possibly, in central part 22.

Figure 2:
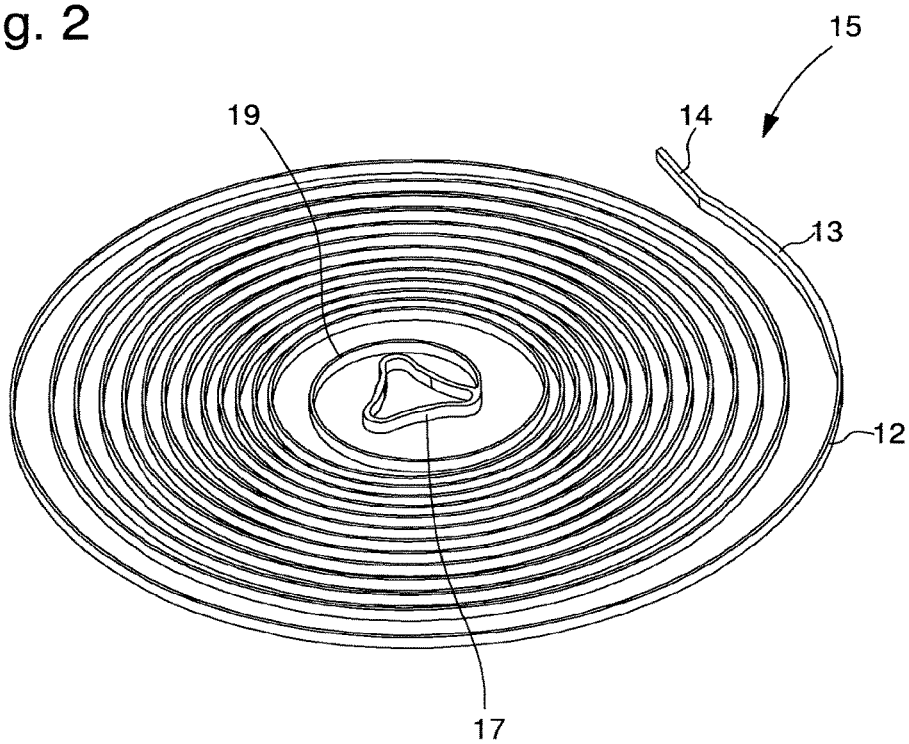
FIG. 2 is an example geometry of a balance spring according to the invention.

Advantageously according to the invention, it is thus possible, with no further complexity, to fabricate, as illustrated in FIG. 2, a balance spring 5*c*, 5, 15 comprising in particular:

- one or more coils of more precise cross-section(s) than that obtained by means of a single etch;
- variations in thickness and/or in pitch along the coil;
- a one-piece collet 17;
- an inner coil 19 of the Grossman curve type
- a one-piece balance spring stud attachment 14;
- a one-piece external attachment element;
- a portion 13 of outer coil 12 and/or of inner coil 19 that is thicker than the rest of the coils.

Finally, method 31 may also comprise step 45 intended to assemble a compensating balance spring 5, 15 obtained in step 41, or a balance spring 5*c* obtained in step 39, to a balance having a predetermined inertia obtained in step 43, to form a resonator 1 of the sprung balance type, which may or may not be temperature compensated, i.e. whose frequency f is or is not sensitive to temperature variations.

Of course, the present invention is not limited to the illustrated example but is capable of various variants and modifications that will appear to those skilled in the art. In particular, as explained above, the balance, even if it has an inertia predefined by design, may comprise movable inertia-blocks offering an adjustment parameter prior to or after the sale of the timepiece.

Further, an additional step could be provided, between step 39 and step 41, or between step 39 and step 45, for depositing a functional or aesthetic layer, such as, for example, a hardening layer or a luminescent layer.

It is also possible to envisage, when method 31 performs, after step 39, one or more iterations of steps 35, 37 and 39, that step 35 is not systematically implemented.

What is claimed is:

1. A method for fabrication of a balance spring of predetermined stiffness, comprising the following:

- forming a balance spring in dimensions smaller than dimensions necessary to obtain said balance spring of predetermined stiffness;
- determining a stiffness of the balance spring formed in the forming by measuring a frequency of said balance spring coupled with a balance having a predetermined inertia;
- calculating a missing thickness of material from said balance spring, based on the stiffness of the balance spring determined in the determining, required to obtain said balance spring of predetermined stiffness; and modifying the balance spring formed in the forming, along a first face of said balance spring that is substantially perpendicular to a height dimension thereof and along another face of said balance spring that is substantially perpendicular to the first face, to compensate for said missing thickness of the material required to obtain the balance spring having said dimensions necessary for said predetermined stiffness.

2. The fabrication method according to claim 1, wherein, in the forming, the dimensions smaller than said dimensions necessary to obtain the balance spring formed in the forming are undersized by between 1% and 20% than said dimensions necessary to obtain said balance spring of said predetermined stiffness after the modifying.

3. The fabrication method according to claim 1, wherein the forming is performed by a deep reactive ion etch.

4. The fabrication method according to claim 1, wherein the forming is performed by a chemical etch.

5. The fabrication method according to claim 1, wherein, in the forming, several balance springs are formed in a same wafer in dimensions smaller than the dimensions necessary to obtain several balance springs each being of a predetermined stiffness, or to obtain several balance springs of several predetermined stiffnesses.

6. The fabrication method according to claim 1, wherein the balance spring formed in the forming is made from silicon.

7. The fabrication method according to any claim 1, wherein the balance spring formed in the forming is made from glass.

8. The fabrication method according to any claim 1, wherein the balance spring formed in the form is made from ceramic.

9. The fabrication method according to any claim 1, wherein the balance spring formed in the forming is made from metal.

10. The fabrication method according to claim 1, wherein the balance spring formed in the forming is made from metal alloy.

11. The fabrication method according to claim 1, wherein the determining includes the following phases:

measuring a frequency of an assembly comprising the balance spring formed in the forming coupled to the balance having the predetermined inertia; and deducing, from the measured frequency, a stiffness of the balance spring formed in the forming.

12. The fabrication method according to claim 1, wherein the modifying includes the following phase:

depositing a layer on one part of an external surface of the balance spring formed in the forming to obtain the balance spring having the dimensions necessary for said predetermined stiffness.

13. The fabrication method according to claim 1, wherein the modifying includes the following phase:

modifying a structure of the material from said balance spring, to a predetermined depth, of one part of an external surface of the balance spring formed in the forming to obtain the balance spring having the dimensions necessary for said predetermined stiffness.

14. The fabrication method according to claim 1, wherein the modifying includes the following phase:

modifying a composition of the material from said balance spring, to a predetermined depth, of one part of an external surface of the balance spring formed in the forming to obtain the balance spring having the dimensions necessary for said predetermined stiffness.

15. The fabrication method according to claim 1, further comprising, after the modifying step, performing, at least once more, the determining, the calculating and the modifying to improve dimensional quality of the balance spring.

16. The fabrication method according to claim 1, further comprising, after the modifying, forming, on at least one part of said balance spring of the predetermined stiffness, a portion for correcting a stiffness of the balance spring and for forming balance spring so that said balance spring is less sensitive to thermal variations.

17. The fabrication method according to claim 16, wherein the forming of the portion includes the following phase:

depositing a layer on one part of an external surface of said balance spring of the predetermined stiffness.

18. The fabrication method according to claim 16, wherein the forming of the portion includes the following phase:

modifying a structure of the material from said balance spring, to a predetermined depth, of one part of an external surface of said balance spring of the predetermined stiffness.

19. The fabrication method according to claim 16, wherein the forming of the portion includes the following phase:

modifying a composition of the material from said balance spring, to a predetermined depth, of one part of an external surface of said balance spring of the predetermined stiffness.

20. A method for fabrication of a balance spring of predetermined stiffness, comprising the following:

forming a balance spring in dimensions smaller than dimensions necessary to obtain said balance spring of predetermined stiffness;

determining a stiffness of the balance spring formed in the forming by measuring a frequency of said balance spring coupled with a balance having a predetermined inertia;

calculating a missing thickness of material from said balance spring, based on the stiffness of the balance spring determined in the determining, required to obtain said balance spring of predetermined stiffness; and modifying the balance spring formed in the forming, by depositing a layer on one part of an external surface of the balance spring formed in the foil ling, to compensate for said missing thickness of the material required to obtain the balance spring having said dimensions necessary for said predetermined stiffness.

* * * * *